US006674980B2

(12) United States Patent
Nakaya

(10) Patent No.: US 6,674,980 B2
(45) Date of Patent: Jan. 6, 2004

(54) IMAGE FORMING APPARATUS CAPABLE OF SHORTENING START UP TIME OF FIXING DEVICE

(75) Inventor: Masahide Nakaya, Kanagawa (JP)

(73) Assignee: Ricoh Co., Ltd., Tokyo (JP)

( * ) Notice: Subject to any disclaimer, the term of this patent is extended or adjusted under 35 U.S.C. 154(b) by 64 days.

(21) Appl. No.: 10/118,140

(22) Filed: Apr. 9, 2002

(65) Prior Publication Data

US 2002/0154919 A1 Oct. 24, 2002

(30) Foreign Application Priority Data

Apr. 9, 2001 (JP) ..... 2001-109882

(51) Int. Cl.[7] ..... G03G 15/20

(52) U.S. Cl. ..... 399/69; 399/70; 219/216

(58) Field of Search ..... 399/33, 37, 67, 399/69, 70, 88; 219/216

(56) References Cited

U.S. PATENT DOCUMENTS 5,966,562 A * 10/1999 Maehara ..... 399/69
6,408,148 B1 * 6/2002 Yamamoto ..... 399/88

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus includes a fixing section, an energy saving power supply section supplied with power when a power switch is turned on, an energy saving control device activated by the power supplied from the energy saving power supply section, a main power supply source controlled by an on and off operation of an output by the energy saving control device, a main body control device activated by the power supplied by the main power supply source, an energy saving control release device to generate an energy saving control release signal, a fixing control section to control a temperature of the fixing section, a switching device to start and stop supplying the power to the fixing section, and an on and off device to start and stop supplying the power to the fixing control section.

12 Claims, 8 Drawing Sheets

IMAGE FORMING APPARATUS CAPABLE OF SHORTENING START UP TIME OF FIXING DEVICE

BACKGROUND OF THE INVENTION

1. Field of the Invention

The present invention relates to an image forming apparatus, and more particularly to the image forming apparatus in which a start up time of a fixing device is shortened.

2. Discussion of the Background

An electrophotographic or ink jet image forming apparatus generally fixes a developer onto a transfer sheet by heating the developer, such as toner or ink, by using a fixing device. In the electrophotographic image forming apparatus, a heater such as a heat roll is generally used as the fixing device. Various studies have been made to stably supply the fixing device with power.

Japanese Patent Laid-Open Publication No. 8-339134 discloses an image forming apparatus having a toner image forming device that forms a toner image on a transfer sheet, a fixing device that fixes the toner image onto the transfer sheet by an electromagnetic induction heating, a temperature controller that controls a temperature of the fixing device, and at least two protectors that stop energization of the fixing device when the fixing device reaches to a temperature equal to or out of a predetermined temperature range. Thus, the image forming apparatus includes two devices (i.e., control systems) that control the temperature of the fixing device to increase reliability of the fixing device.

Japanese Patent Laid-Open Publication No. 9-197856 discloses an induction heating fixing device that includes a heated member formed of a conductive member, a coil to inductively heat the heated member, a inverter circuit to supply the coil with a high frequency, a thermistor that detects a temperature of the heated member, an output control circuit (which is electrically insulated from the inverter circuit) to control the inverter circuit based on a temperature detected by the thermistor such that the temperature of the heated member is maintained within a predetermined range, and an insulating interface that transmits a control signal input from the output control circuit to the inverter circuit while electrically insulating the control signal. Thus, the induction heating fixing device is configured to control a temperature with a low temperature ripple by electrically insulating a first circuit from a second circuit.

In a conventional image forming apparatus, because a temperature is detected with single sensor, an abnormal temperature condition occurs. Moreover, in recent years, a demand for energy savings is increasing in an image forming apparatus. Thus, attempts have been made to save energy. For example, energization of a fixing device is cut off in a standby state, or the fixing device is maintained at a temperature lower than a fixing temperature in the standby state. The present inventors have recognized that in such an image forming apparatus having an energy saving function, a quick start up is required when an image forming operation is performed. However, no technology for shortening the start up time is discussed in the above-described Japanese Patent Laid-Open Publications.

SUMMARY OF THE INVENTION

The present invention has been made in view of the above-mentioned and other problems, and addresses the above-discussed and other problems.

The present invention advantageously provides a novel image forming apparatus in which a start up time is shortened, while supplying a fixing device with power from an auxiliary power supply source when starting up the fixing device.

According to an example of the present invention, an image forming apparatus includes a fixing section configured to fix a developer transferred on a transfer sheet onto the transfer sheet by heating the transfer sheet, an energy saving power supply section configured to be supplied with power when a power switch is turned on, an energy saving control device configured to be activated by the power supplied from the energy saving power supply section, a main power supply source configured to be controlled by an on and off operation of an output by the energy saving control device, a main body control device configured to be activated by the power supplied by the main power supply source, an energy saving control release device configured to generate an energy saving control release signal so as to input the signal to the energy saving control device, and a fixing control section configured to control a temperature of the fixing section. The image forming apparatus also includes a switching device configured to start and stop supplying the power to the fixing section, and an on and off device configured to start and stop supplying the power to the fixing control section in response to the switching device. The energy saving power supply section includes an auxiliary power supply source that supplies the fixing control section with the power through the on and off device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
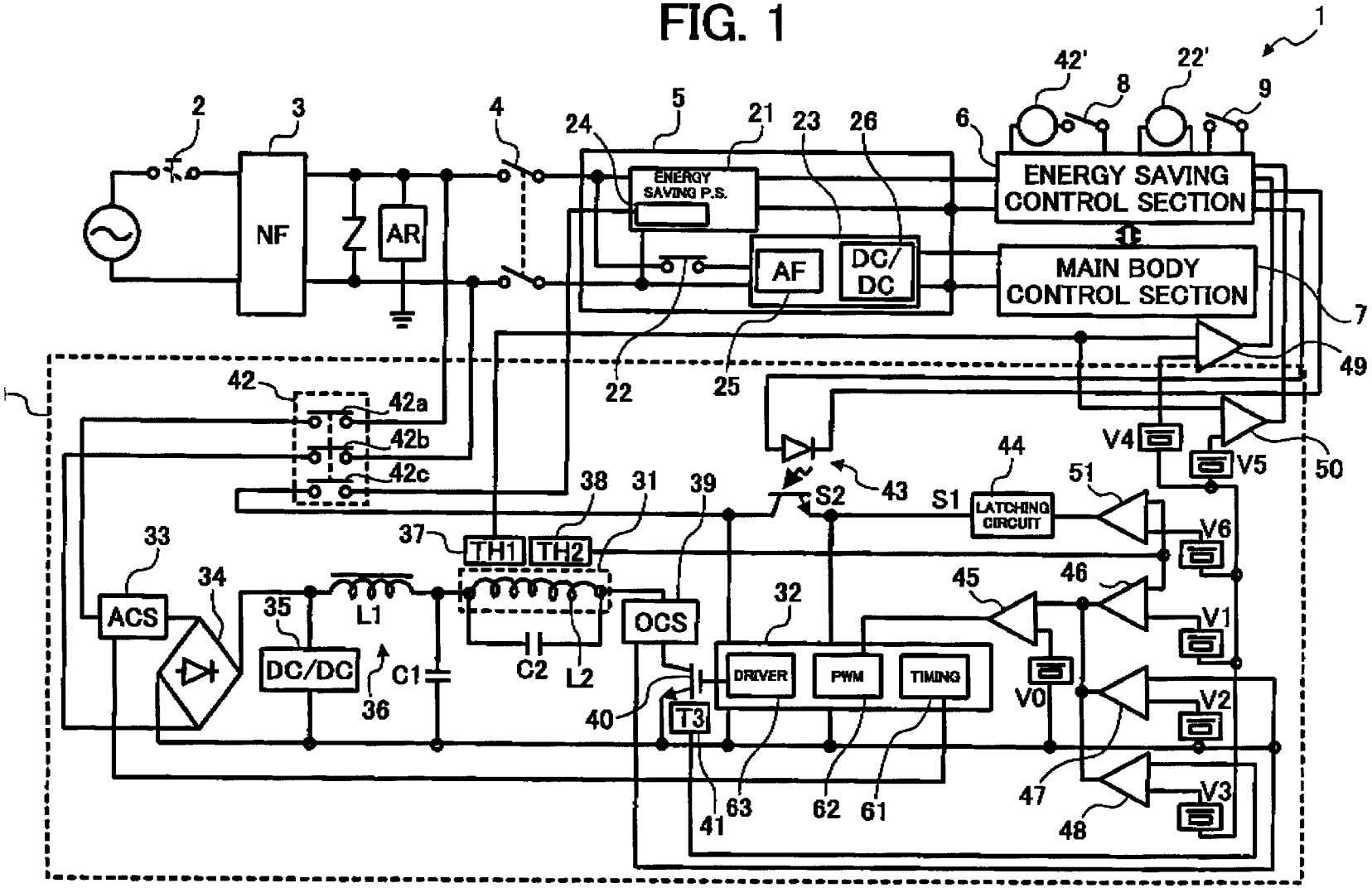
FIG. 1 is a diagram illustrating a main circuit of an image forming apparatus according to an example of the present invention.

Referring now to the drawings, wherein like reference numerals designate identical or corresponding parts throughout the several views, an example of the present invention is described.

FIGS. 1 through 8 illustrate an image forming apparatus as an example of the present invention. FIG. 1 is a diagram illustrating a circuit of an electrophotographic image forming apparatus 1 as an example of the image forming apparatus according to the present invention. In the image forming apparatus 1, power supplied to the image forming apparatus 1 is effectively utilized such that the time required to have the image forming apparatus 1 in an operational state from a standby state is shortened while reducing consumed electric power during standby.

In FIG. 1, the image forming apparatus 1 includes a circuit breaker 2, a noise filter 3, a main switch 4, a DC power source 5, an energy saving control section 6, a main body control section 7, a door switch 8, an energy saving control release switch 9, and a fixing section 30.

The DC power source 5 includes an energy saving power supply section 21, a main power supply relay 22, and a main power supply source 23. The energy saving power supply section 21 includes an auxiliary power supply source 24. The main power supply source 23 includes an active filter 25 and a multi-output converter (DC/DC) 26.

The fixing section 30 includes a fixing roller 31, a fixing control section 32, an AC detecting section (i.e., ACS), a diode bridge 34, a filter 36, temperature detection sensors 37 and 38 (i.e., inverter thermistors), and an overcurrent detector 39 (i.e., OCS). The filter 36 includes a DC/DC converter 35, a coil L1, and a capacitor C1. The fixing section 30 further includes a switching element 40, a temperature detection sensor 41 (i.e., TS) for the switching element 40, a power relay 42, a photo coupler 43, a latching circuit 44, and seven comparators 45 through 51. The fixing roller 31 internally includes a coil L2 for an induction heating. A capacitor C2 that constitutes a resonance circuit is connected in parallel with the coil L2. A reference voltage of V0 through V6 is input to the comparators 45 through 51, respectively.

Power (i.e., AC power) is applied to the image forming apparatus 1 through the circuit breaker 2 and noise filter 3. The AC power is then divided into two branches to be supplied to the DC power source 5 via the main switch 4 (i.e., a power switch), and the power relay 42 of the fixing section 30.

The DC power source 5 internally branches to supply the AC power (which is supplied via the main switch 4) to the energy saving power supply section 21, and main power supply source 23 through the main power supply relay 22. The main power supply source 23 filters the AC power supplied through the main power supply relay 22 with the active filter 25. The multi-output converter 26 converts the AC power into a predetermined voltage and outputs the voltage to the main body control section 7 (i.e., a main body control device).

The energy saving control section 6 (i.e., an energy saving control device) is connected to the energy saving power supply section 21 to receive an output from the energy saving power supply section 21. The energy saving control release switch 9 (i.e., an energy saving control release device) is connected to the energy saving control section 6. The energy saving control release switch 9 generates an energy saving control release signal. A coil of the power relay 42' is connected to the energy saving control section 6 via the door switch 8. In addition, a coil of the main power supply relay 22' is connected to the energy saving control section 6. The door switch 8 turns on and off in response to an open/close operation of a cover (not shown) of the image forming apparatus 1.

In the fixing section 30, the AC power is supplied to the filter 36 including the coil L1 and capacitor C1 through contacts 42*a*, 42*b* (i.e., a switching device) of the power relay 42, AC detecting section 33, and diode bridge 34. The AC power is then supplied to the switching element 40 through the coil L2, which provides induction heating, a resonance circuit of a condenser C2, and the overcurrent detector 39. The switching element 40 is connected to the fixing control section 32 to receive an output from the fixing control section 32. The fixing control section 32 includes a timing circuit 61, a PWM circuit 62, and a driving circuit 63 (i.e., a driver). The timing circuit 61 generates an "ON" signal that drives switching element 40.

The auxiliary power supply source 24, included inside the energy saving power supply section 21 of the DC power source 5, supplies the fixing control section 32 with driving power via a contact 42*c* (i.e., an on/off device) of the power relay 42. Namely, contact 42*a*, 42*b*, and 42*c* of the power relay 42 control a supply/shutdown of the power supplied to the fixing section 30 and the power supplied to the fixing control section 32 from the auxiliary power supply source 24. The on/off device (i.e., contact 42*c*) operates in response to the switching device (i.e., contacts 42*a* and 42*b*) because contacts 42*a*, 42*b*, and 42*c* are operated by a same coil.

An output of AC detecting section 33 and an applied voltage of the switching element 40 are input to the timing circuit 61. Respective output control signals are input to the PWM circuit 62 through the comparator 45. The comparator 45 is connected to the three comparators 46 through 48 to receive an output from the three comparators 46 through 48. The temperature detection sensor 38 for the fixing roller 31 is connected to the comparator 46. The overcurrent detector 39 and the temperature detection sensor 41 for the switching element 40 are connected to the comparators 47 and 48, respectively. The reference voltages V0 through V3 are input to the comparators 45 through 48, respectively. Two lines of signals (i.e., power restriction signals S1 and S2) are connected to the PWM circuit 62. The power restriction signal S2 is input from the energy saving control section 6 via the photo coupler 43. The power restriction signal S1 is input from the comparator of 51 via the latching circuit 44.

The temperature detection sensor (thermistor) 37 for the fixing roller 31 is connected to the energy saving control section 6 via the comparators 49 and 50.

Figure 2:
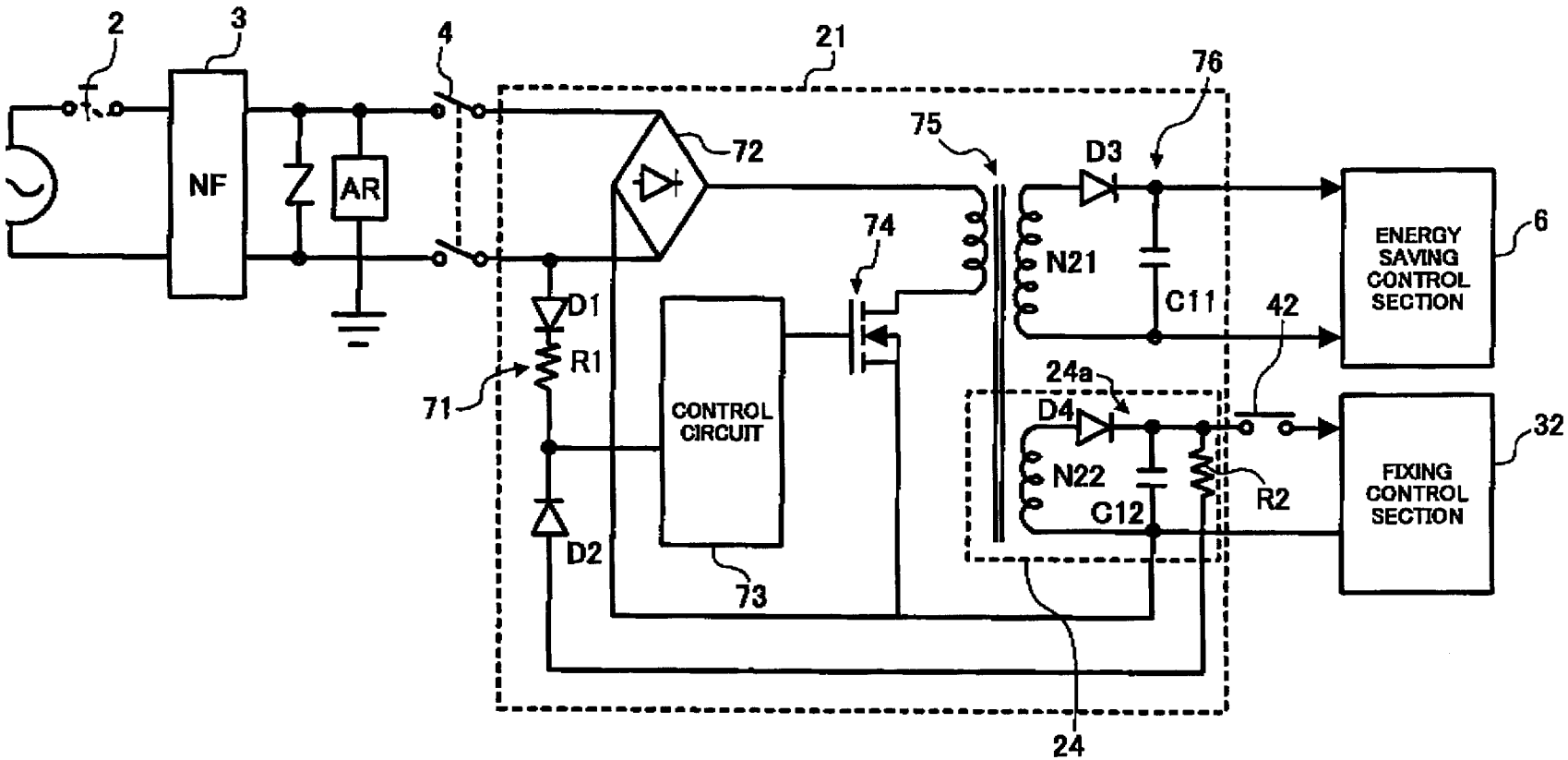
FIG. 2 is a diagram illustrating a circuit of an energy saving power supply section.

The energy saving power supply section 21 is configured as illustrated in FIG. 2. The energy saving power supply section 21 includes a starting circuit 71, a diode bridge 72, a control circuit 73, a switching element 74, a transformer 75, a rectifier circuit 76, a diode D2, and the auxiliary power supply source 24. The starting circuit 71 includes a diode D1 and resistor R1. A winding N21, and winding N22 for the auxiliary power supply source 24 are provided in the secondary side of the transformer 75. The rectifier circuit 76, including a diode D3 and capacitor C11, is connected to the winding N21. A rectifier circuit 24*a*, including a diode D4 and capacitor C12, and a resistor R2 are connected to the winding N22.

When AC power is supplied through the main switch 4, the starting circuit 71 supplies a power supply terminal of the control circuit 73 with driving power to activate the energy saving power supply section 21. The energy saving power supply section 21 outputs a power supply voltage through the transformer 75 and rectifier circuit 76 while controlling an operation of the switching element 74. The energy saving power supply section 21 supplies the power of the control circuit 73 through the resistor R2 of the auxiliary power supply source 24 after the diode bridge 72 is activated. As illustrated in FIG. 2, the auxiliary power supply source 24 supplies the fixing control section 32 of the fixing section 30 with power via the power relay 42. The energy saving power supply section 21 supplies the energy saving control section 6 with the power to activate the energy saving control section 6.

Figure 3:
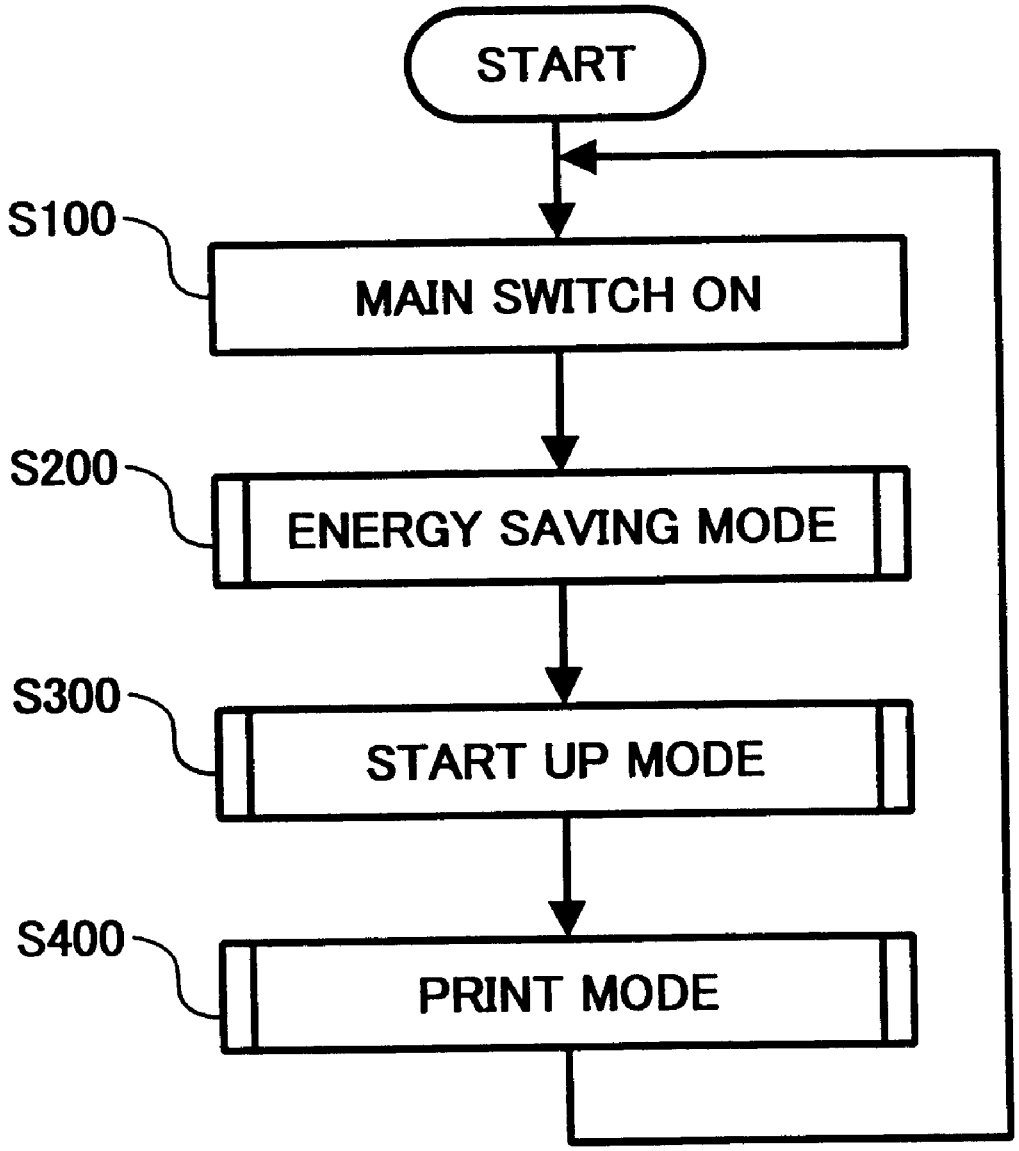
FIG. 3 is a flow chart illustrating an overall process performed in the image forming apparatus in FIG. 1.

Operation of the present invention is now described. FIG. 3 is a flow chart illustrating an overall process performed in the image forming apparatus 1. When the main switch 4 is turned on at step S100, an energy saving mode process (during standby), a start up mode process (in a start up operation), and a print mode process (in a printing operation) are performed in sequence at steps S200, S300 and S400, respectively. Namely, when the main switch 4 is turned on at step S100, the image forming apparatus 1 is put into the energy saving mode (i.e., standby state) at step S200. When the energy saving control release switch 9 is depressed while the image forming apparatus 1 is in the energy saving mode, the image forming apparatus 1 is put into the start up mode at step S300. Then, the start up operation, in which the fixing roller 31 is heated to a predetermined temperature (i.e., a reloading), is performed to get the fixing section 30 up and running. When the energy saving control section 6 detects the reloading, main power of the image forming apparatus 1 is activated. When the start up operation of the fixing section 30 is completed, the image forming apparatus 1 is placed into the print mode to perform a printing process at step S400. After the printing process is performed, if a condition to proceed to the standby state is satisfied (for example, when a following printing process is not performed within a predetermined period of time after a printing process has been finished), the image forming apparatus is placed into the energy saving mode (i.e., a standby state).

As indicated above, the image forming apparatus 1 includes the fixing section 30, which is an induction heating system. The temperature detection sensors 37 and 38 are provided in both the fixing section 30 and energy saving control section 6 (the temperature detection sensors 37 and 38 in the energy saving control section 6 are not shown) to assure safety.

Figure 4:
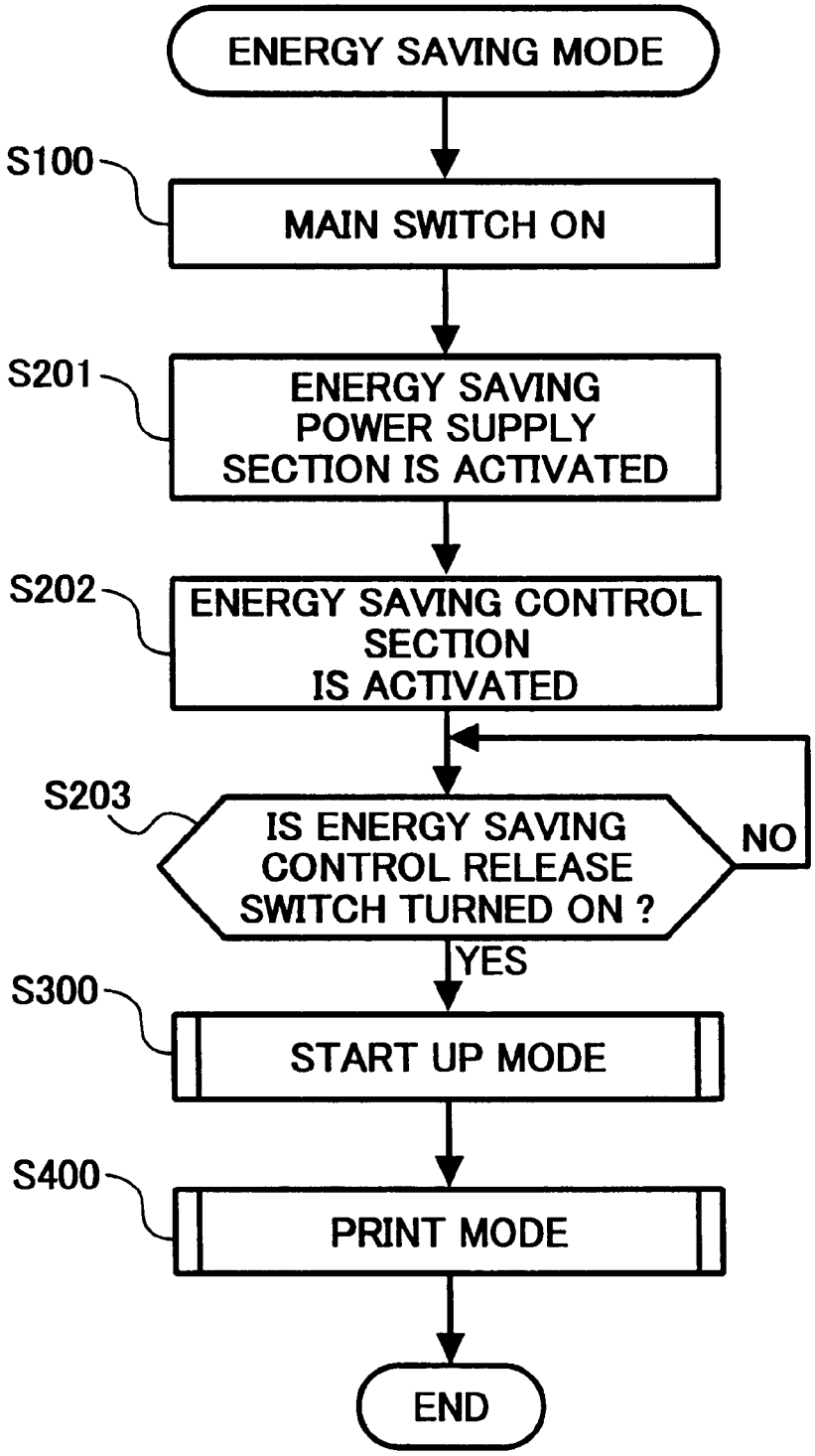
FIG. 4 is a flow chart illustrating a process in an energy saving mode.

As illustrated in FIG. 4, when the main switch 4 is turned on at step S100 while the image forming apparatus is in the energy saving mode, AC power is supplied to the energy saving power supply section 21 of the DC power source 5. The energy saving power supply section 21 is thus activated at step S201. The energy saving control section 6 is activated by an output of the energy saving power supply section 21 at step S202. Thus, the image forming apparatus 1 is put into the energy saving mode.

The energy saving control section 6 determines whether or not the energy saving control release switch 9 is depressed at step S203 based on whether or not a energy saving control release signal is input. When the energy saving control release signal is input, the energy saving control section 6 determines that the energy saving control release switch 9 is depressed. Thus, the energy saving mode is released and the image forming apparatus 1 is put into the start up mode at step S300. Namely, in the energy saving mode, the image forming apparatus 1 stays in a standby state until the energy saving control release switch 9 is depressed either by an operator or a signal to perform a copy or print process.

Figure 5:
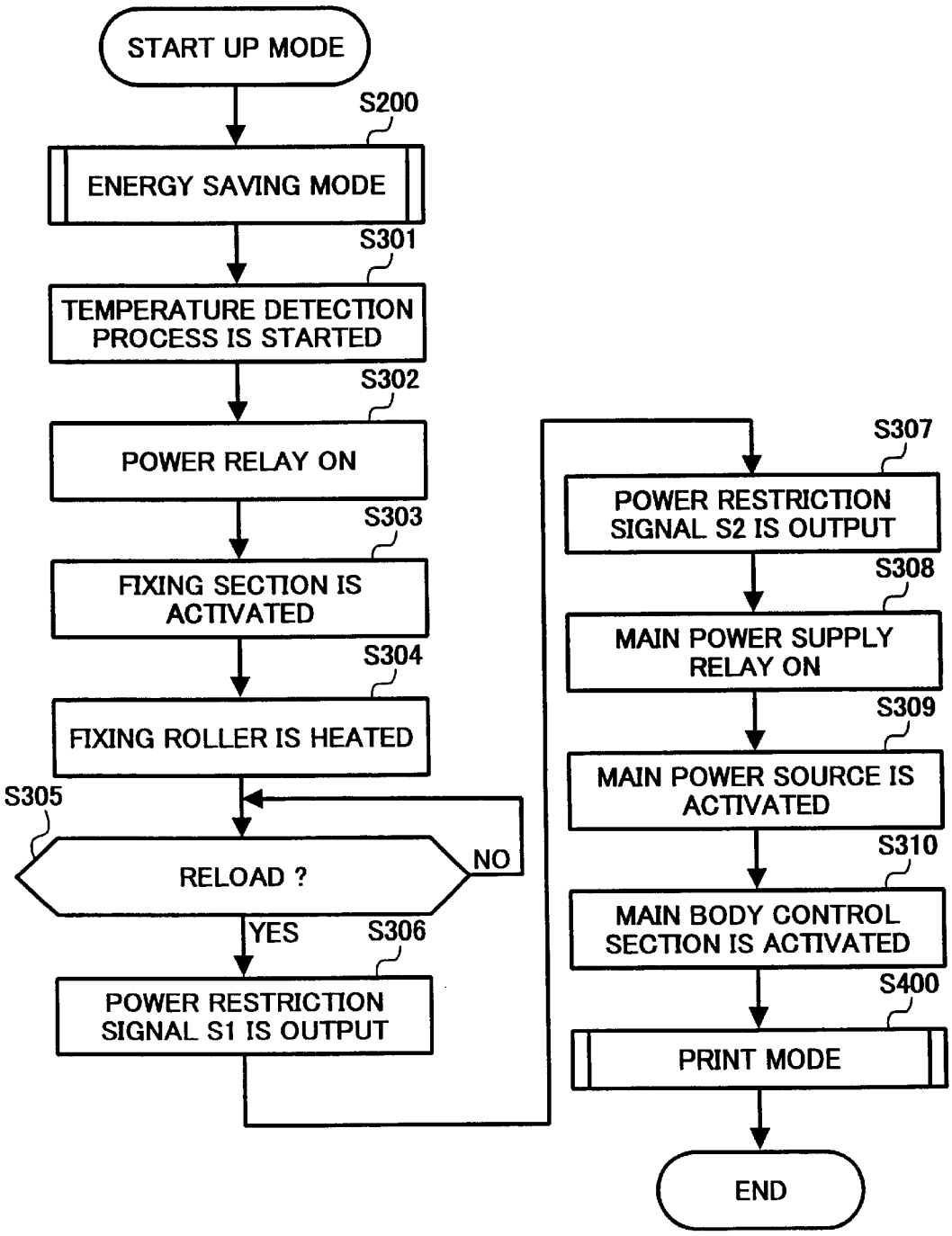
FIG. 5 is a flow chart illustrating a process in a start up mode.

As illustrated in FIG. 5, in the start up mode, the energy saving control section 6 starts a temperature detection process (which is an interrupting process) at step S301. When the temperature detection process is performed, the temperature detection process is maintained until the main switch 4 is turned off. When the energy saving control section 6 starts the temperature detection process, the power relay 42 is turned on at step S302 to supply the fixing section 30 with AC power. At the same time, auxiliary power is supplied to the fixing section 30 from the auxiliary power supply source 24 of the energy saving power supply section 21. In the fixing section 30, the AC power is supplied to the diode bridge 34 through the AC detecting section 33. Thus, the fixing control section 32 is activated to control a fixing operation. The fixing section 30 is then activated at step S303. The fixing control section 32 generates an "ON" signal for the switching element 40 so that an output of the comparator 45 (which is input to the PWM circuit 62) reaches to a predetermined value. The fixing control section 32 then outputs the "ON" signal to the switching element 40 via the driving circuit 63.

When the switching element 40 starts a switching operation, a driving current of several tens of KHz passes through the coil L2 provided inside the fixing roller 31. Thus, a magnetic flux linked with the fixing roller 31 is generated, and an eddy current flows to a conductive portion of the fixing roller 31. The fixing roller 31 is then heated by the Joule heat at step S304.

The temperature detection sensor 38 provided to the fixing roller 31 detects a temperature of the fixing roller 31. A detection signal of the temperature of the fixing roller 31 is compared with the reference voltage V1 (i.e., a target fixing temperature). A difference caused in the comparison result is input to the PWM circuit 62 through the comparator 45. The PWM circuit 62 generates a driving signal having a pulse width corresponding to the voltage difference. The driving signal is output to the switching element 40 through the driving circuit 63 to control the temperature of the fixing roller 31. A maximum pulse width of the driving signal, which is generated by the PWM circuit 62, is set at two different values according to power consumed by the fixing section 30 during startup operation and other operations.

A first pulse width that occurs during startup is set such that power input to the fixing section 30 becomes the maximum value allowed as an input power of the image forming apparatus 1. More specifically, when the maximum input power of the image forming apparatus 1 is 1500 W, the maximum pulse width is previously set such that the fixing section consumes 1450 W of power, with the remaining 50 W of power consumed by the energy saving power supply section 21 and energy saving control section 6. Thus, a large portion of the total power is directed to heating the coil L1 during startup. A second pulse width is set such that a value of the power consumed by the fixing section 30 becomes lower than a value of the power consumed for a start up operation of the fixing section 30, after the start up of the fixing section 30 has been completed.

In the fixing section 30, the respective reference voltages of the comparators 46, 47, and 48 are set such that priority control is given to the comparator 46 over the comparators 47 and 48. The comparators 47 and 48 regulate the pulse width of the driving signal only when unusual events occur in the fixing section 30. Whether or not the fixing roller 31 is heated to a temperature capable of a fixing operation (for example, 185° C.) and the reload is detected in the fixing section 30 is determined at step S305. When the fixing roller 31 is heated to the temperature capable of the fixing operation, the comparator 51 produces an output to activate the latching circuit 44. The power restriction signal S1 is then output to the PWM circuit 62 at step S306.

A pulse width of the driving signal generated by the PWM circuit 62 is regulated such that a power value input to the image forming apparatus 1 is not greater than a second power value so as to regulate the power consumed by the fixing section 30. More specifically, when a maximum input power of the image forming apparatus 1 is 1500 W, a maximum pulse width is previously set such that the fixing section 30 consumes 900 W of power except for 600 W of power consumed by the DC power source 5, energy saving control section 6, and main body control section 7.

The comparator 47 detects an overcurrent of the switching element 40, while the comparator 48 detects a temperature of the switching element 40. The reference voltages V2 and V3 of the respective comparators 47 and 48 are set such that the driving signal of the switching element 40 is turned off when a flow of an overcurrent or an abnormal temperature of the switching element 40 is detected. In addition, the temperature detection sensor 37 detects the temperature of the fixing roller 31. A detection result of the temperature detection sensor 37 is input to the energy saving control section 6. As seen in FIG. 1, two lines of temperature information are input to the energy saving control section 6 from the comparators 49 and 50, respectively, and a temperature detection level of the comparators 49 and 50 is set to a different value each other.

The comparator 49 also detects an occurrence of an abnormal condition. If the temperature information of the fixing roller 31 input to the comparator 49 indicates that the temperature of the fixing roller 31 exceeds a previously set reference value, the energy saving control section 6 determines that something unusual occurred in the fixing section 30. Thus, the power relay 42 is turned off to stop power supply to the fixing section 30. The comparator 50 detects the reload of the fixing roller (i.e., whether of not the fixing roller 31 is heated to a temperature capable of performing a fixing operation).

When the energy saving control section 6 detects the reload based on an output of the comparator 50, the energy saving control section 6 outputs the power restriction signal S2 to the PWM circuit 62 via the photo coupler 43. When the PWM circuit 62 receives the power restriction signal S2, the PWM circuit 62 sets the second pulse width.

The energy saving control section 6 turns the main power supply relay 22 on at step S308. Thus, the main power supply source 23 is activated to supply the main body control section 7 with low-voltage power at step S309. When the low-voltage power is supplied to the main body control section 7 from the main power supply source 23, the main body control section 7 is activated at step S310. The image forming apparatus 1 then completes the start up mode and proceeds to the print mode at step S400.

Figure 6:
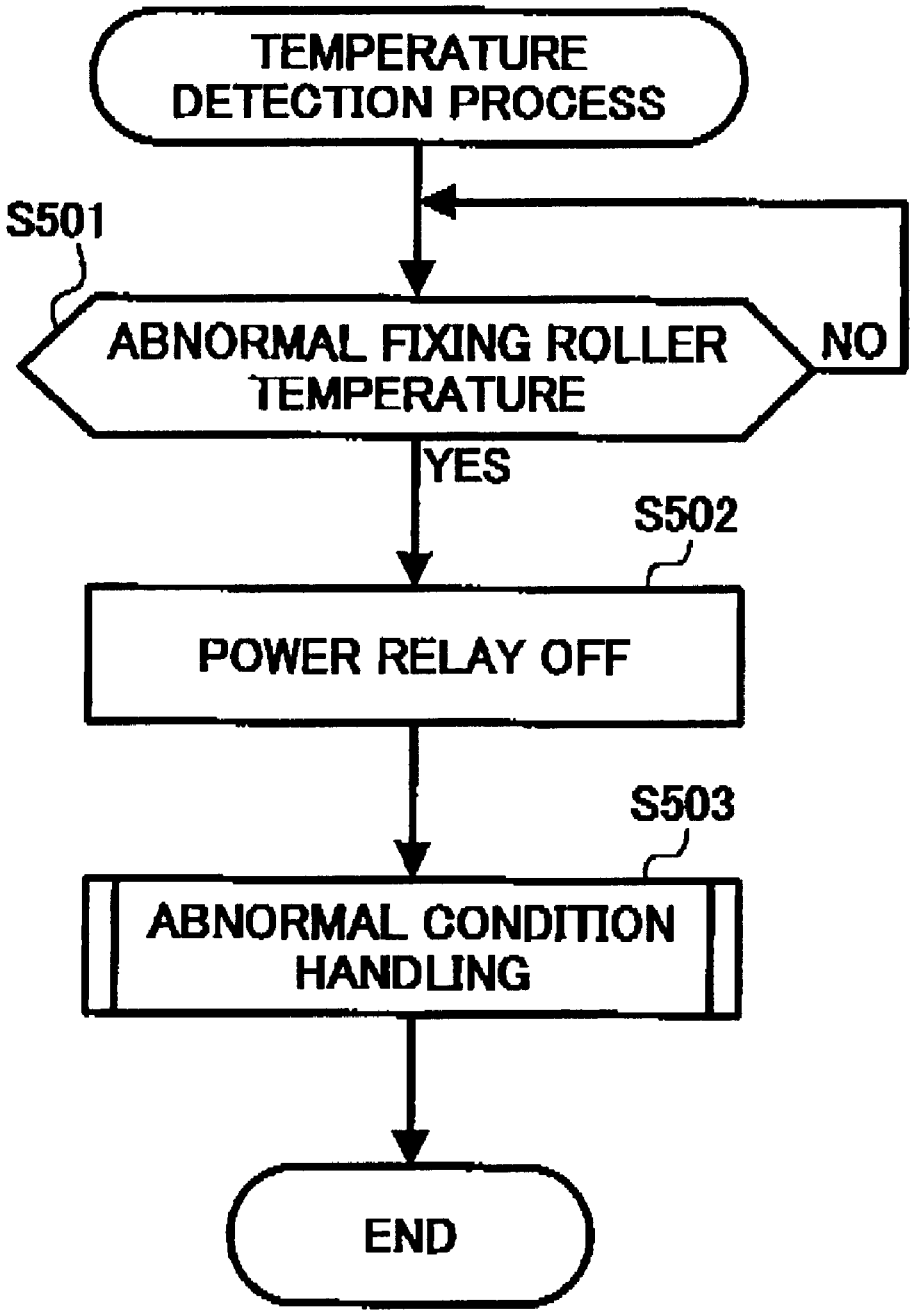
FIG. 6 is a flow chart illustrating a process of temperature detection.

FIG. 6 illustrates the temperature detection process of step S301 in FIG. 5. As seen in FIG. 6, whether or not the temperature of the fixing roller 31 is abnormal is determined at step S501. If the temperature of the fixing roller 31 is abnormal (for example, the temperature is not less than 220° C.), the power relay 42 is turned off at step S502 (which is an interrupting process) to stop energization of the fixing section 30. An abnormal detection signal is transmitted from the energy saving control section 6 to the main body control section 7. When the main body control section 7 receives the signal, the main body control section 7 handles an abnormal condition at step S503 (for example, displaying the abnormal condition).

When the temperature of the fixing roller 31 is detected to be normal at step S501, the energy saving control section 6 turns the power relay 42 on at step S302 to activate the fixing section 30 at step S303. Thus, the fixing roller 31 is heated at step S304 as shown in FIG. 5.

Figure 7:
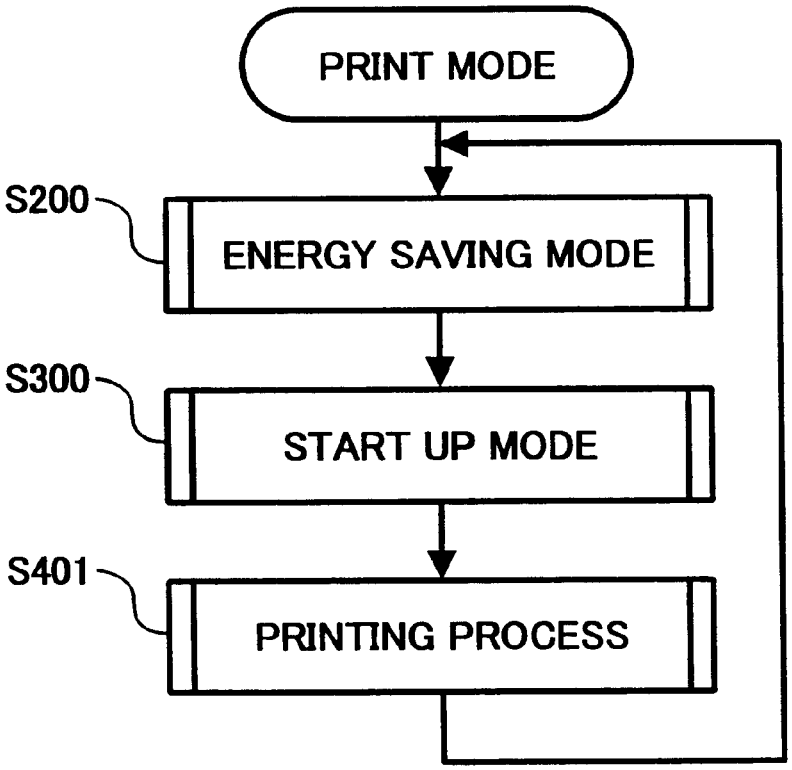
FIG. 7 is a flow chart illustrating a process in a print mode.

As illustrated in FIG. 7, in the print mode, the image forming apparatus 1 performs a printing process at step S401 when the image forming apparatus enters a state in which a printing process is performed. As seen in FIG. 7, the printing process occurs after the image forming apparatus is placed in the start up mode (step S300) from the energy saving mode (step S200) and after the start up process is performed. As noted above, the image forming apparatus 1 is placed in the energy saving mode (step S200) after performing the printing process, if a previously set standby condition is satisfied. In the print mode, a power restriction signal is input to the PWM circuit 62 of the fixing control section 32. Thus, the fixing roller 31 is controlled such that a temperature thereof detected by the temperature detection sensor 38 is maintained at a predetermined fixing temperature, while regulating a pulse width of a driving signal generated by the PWM circuit 62 such that the pulse width is not greater than the second pulse width of the driving signal which is output to the switching element 40.

Figure 8:
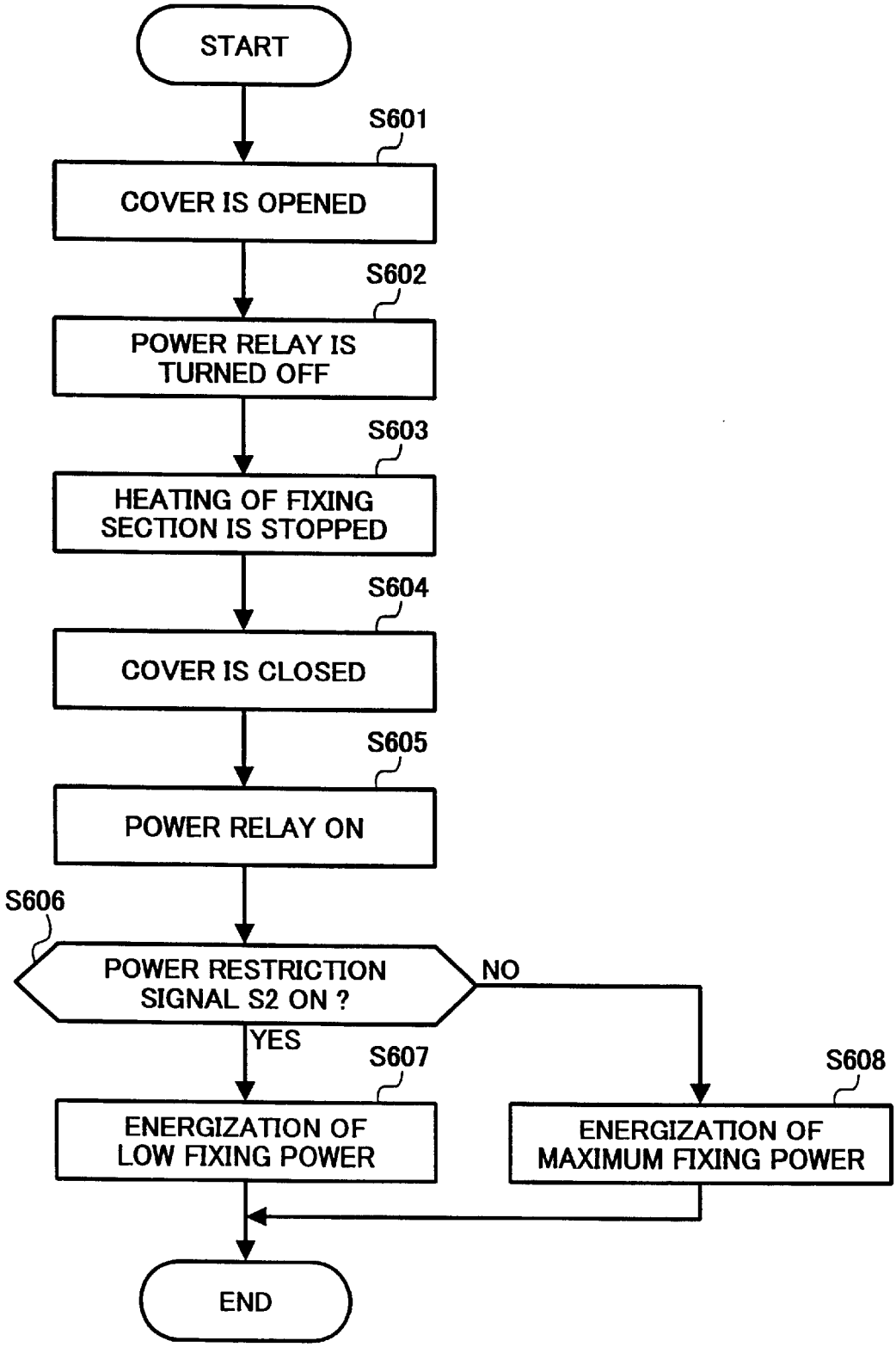
FIG. 8 is a flow chart illustrating a process when a cover of the image forming apparatus is opened.

An operational process performed when the door switch 8 is opened/closed is now described referring to FIG. 8. When the door switch 8 detects that a cover of the image forming apparatus 1 is opened, the energy saving control section 6 stops energization of the fixing section 30 to prevent an operator from receiving an electric shock. Namely, when the cover of the image forming apparatus 1 is opened and the door switch 8 is turned off at step S601, the energy saving control section 6 stops energization of a coil of the power relay 42' to turn the power relay 42 off at step S602. When the power relay 42 is turned off, energization of the fixing section 30 is stopped. Thus, a heating of the fixing roller 31 is stopped at step S603.

When the cover of the image forming apparatus 1 is closed and the door switch 8 is turned on at step S604, the energy saving control section 6 starts energization of the coil of the power relay 42' to turn the power relay 42 on. Thus, the fixing section 30 is activated again at step S605. At this time, the energy saving control section 6 determines whether the power restriction signal S2 is "ON" at step S606. If the power restriction signal S2 is input via the photo coupler 43 in the reload state, the heating of the fixing roller 31 is restarted while regulating the maximum pulse width of the driving signal input to the switching element 40 to be equal to the second pulse width. Namely, when the heating of the fixing roller 31 is restarted at step S607, low fixing power, which is lower than the power supplied during a start up operation, is supplied.

During a start up operation, when the power restriction signal S2 is "OFF" at step S606, the heating of the fixing roller 31 is restarted while the pulse width of the driving signal is switched to the first pulse width. Namely, maximum power consumed in the fixing section 30 (i.e., maximum fixing power) is supplied at step S608 for heating the fixing roller 31.

The image forming apparatus 1 includes the auxiliary power supply source 24 in the energy saving power supply section 21 such that power is supplied from the auxiliary power supply source 24 to the fixing control section 32 via the power relay 42. The image forming apparatus 1 is configured to proceed to the print mode from the energy saving mode after the apparatus goes into the start up mode. Thus, limited power input to the image forming apparatus 1 is effectively used, resulting in shortening a start up time of the image forming apparatus 1 having the energy saving mode. More specifically, in the start up mode, a consumption of power in components other than the fixing section 30 is maintained low. Thus, an allocation of the power to the fixing section 30 is increased, resulting in a short start up time.

In the image forming apparatus 1, the energy saving control section 6 controls an on/off operation of the power relay 42 based on an energy saving control release signal output from the energy saving control release switch 9. Thus, when the power relay 42 is turned off, a flowing current of the power relay 42 is turned off after controlling power of the fixing section 30 is turned off, thereby increasing a reliability of the power relay 42. Hence, a construction of a circuit is simplified and a consumption of power is reduced, resulting in an increased reliability of the circuit.

In addition, an on/off operation of the power relay 42 is performed based on a control signal output either from the energy saving control section 6 or main body control section 7. Thus, when abnormal conditions are encountered in the fixing section 30, the main body control section 7 also can stop energization of the fixing control section 32, resulting in a simplified construction and reduced consumption of power of a circuit. Further, an occurrence of an electric shock and abnormal condition is prevented.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2001-109882, filed on Apr. 9, 2001, and the entire contents thereof are herein incorporated by reference.

What is claimed is:

1. An image forming apparatus, comprising:

a fixing section configured to fix a developer transferred on a transfer sheet onto the transfer sheet by heating the transfer sheet;

an energy saving power supply section configured to be supplied with power when a power switch is turned on;

an energy saving control device configured to be activated by the power supplied from the energy saving power supply section;

a main power supply source configured to be controlled by an on and off operation of an output by the energy saving control device;

a main body control device configured to be activated by the power supplied by the main power supply source;

an energy saving control release device configured to generate an energy saving control release signal and input the energy saving control release signal to the energy saving control device;

a fixing control section configured to control a temperature of the fixing section;

a switching device configured to start and stop supplying the power to the fixing section; and an on and off device configured to start and stop supplying the power to the fixing control section in response to the switching device, wherein the energy saving power supply section includes an auxiliary power supply source, and wherein the auxiliary power supply source supplies the fixing control section with the power through the on and off device.

2. The image forming apparatus according to claim 1, wherein the energy saving control device controls an on and off operation of the on and off device based on the energy saving control release signal output from the energy saving control release device.

3. The image forming apparatus according to claim 1, wherein the on and off operation of the on and off device is performed based on one of two control signals output from the energy saving control device and main body control device.

4. The image forming apparatus according to claim 1, wherein the fixing device is supplied with a first level of power in a startup mode and a second level of power less than said first level in a non-startup mode.

5. An image forming apparatus, comprising:

means for fixing a developer transferred on a transfer sheet onto the transfer sheet;

an energy saving power supply section configured to be supplied with power when a power switch is turned on;

an energy saving control device configured to be activated by the power supplied from the energy saving power supply section;

a main power supply source configured to be controlled by an on and off operation of an output by the energy saving control device;

a main body control device configured to be activated by the power supplied by the main power supply source;

means for generating an energy saving control release signal and inputting the energy saving control release signal to the energy saving control device;

means for controlling a temperature of the means for fixing;

means for switching a start and stop of supplying the power to the means for fixing; and means for turning on and off the supply of power to the fixing control section in response to the means for switching, wherein the energy saving power supply section includes an auxiliary power supply source, and wherein the auxiliary power supply source supplies the means for controlling with the power through the means for turning on and off.

6. The image forming apparatus according to claim 5, wherein the energy saving control device controls an on and off operation of the means for turning on and off based on the energy saving control release signal output from the means for generating.

7. The image forming apparatus according to claim 5, wherein the on and off operation of the means for turning on and off is performed based on one of two control signals output from the energy saving control device and main body control device.

8. The image forming apparatus according to claim 5, wherein the fixing device is supplied with a first level of power in a startup mode and a second level of power less than said first level in a non-startup mode.

9. A method for supplying an image forming apparatus with power, comprising:

providing a fixing section configured to fix a developer transferred on a transfer sheet onto the transfer sheet;

turning on a power switch;

supplying an energy saving power supply section with power when the power switch is turned on;

supplying an energy saving control device with the power;

controlling an on and off operation of an output of a main power supply source;

supplying a main body control device with the power;

generating an energy saving control release signal;

controlling a temperature of the fixing section;

switching a start and stop of supplying the power to the fixing section;

turning on and off the supply of power to the fixing control section;

providing an auxiliary power supply source to the energy saving power supply section; and supplying the power from the auxiliary power supply source in the controlling step through the turning on and off step.

10. The method according to claim 9, further comprising:

controlling an on and off operation in the turning on an off step based on the energy saving control release signal.

11. The method according to claim 9, further comprising:

generating a control signal from a main body control device; and performing an on and off operation in the turning on and off step based on one of the energy saving control signal and the control signal.

12. The method according to claim 9, further comprising:

supplying a first level of power to the fixing section in a startup mode of the image forming apparatus; and supplying a second level of power less than said first level in a non-startup mode of the image forming apparatus.

* * * * *